US009416790B2

(12) United States Patent
Brenne et al.

(10) Patent No.: US 9,416,790 B2
(45) Date of Patent: Aug. 16, 2016

(54) METHOD AND APPARATUS FOR COMPOSITION BASED COMPRESSOR CONTROL AND PERFORMANCE MONITORING

(75) Inventors: Lars Brenne, Sandnes (NO); Jan Høydal, Stavanger (NO)

(73) Assignee: STATOIL ASA (NO)

( * ) Notice: Subject to any disclaimer, the term of this patent is extended or adjusted under 35 U.S.C. 154(b) by 641 days.

(21) Appl. No.: 13/809,742

(22) PCT Filed: Jul. 14, 2011

(86) PCT No.: PCT/EP2011/062078
§ 371 (c)(1),
(2), (4) Date: Mar. 4, 2013

(87) PCT Pub. No.: WO2012/007553
PCT Pub. Date: Jan. 19, 2012

(65) Prior Publication Data

US 2013/0170952 A1 Jul. 4, 2013

(30) Foreign Application Priority Data

Jul. 14, 2010 (NO) ..... 20101007

(51) Int. Cl.
*F04D 27/02* (2006.01)

(52) U.S. Cl.
CPC ..... *F04D 27/0223* (2013.01); *F04D 27/0207* (2013.01)

(58) Field of Classification Search
CPC ..... F04D 27/001; F04D 27/0215; F04D 27/0223; F04D 27/0246
USPC ..... 415/17, 26–28; 62/83
See application file for complete search history.

(56) References Cited

U.S. PATENT DOCUMENTS 3,292,846 A 12/1966 Harper et al.
3,424,370 A 1/1969 Law
4,156,578 A 5/1979 Agar et al.

(Continued)

FOREIGN PATENT DOCUMENTS

CA 2522760 A1 11/2004
EP 0140499 A2 5/1985

(Continued)

OTHER PUBLICATIONS

Norwegian Search Report, Patent Application No. 20101007, 2 pp., Feb. 14, 2011.

*Primary Examiner* — Justin Jonaitis
*Assistant Examiner* — Christopher Brunjes
(74) *Attorney, Agent, or Firm* — Volpe and Koenig, P.C.

(57) ABSTRACT

A method and apparatus controls a compressor, where the compressor inlet gas may contain water and/or non-aqueous liquid. The method includes the steps of measuring temperature at the compressor inlet and/or outlet side, measuring pressure at the compressor inlet and outlet side in order to determine a compressor pressure ratio, measuring fluid mixture density at the compressor inlet and/or outlet side, measuring individual volume fractions of gas, water and non-aqueous liquid at the compressor inlet and/or outlet side, measuring fluid velocity at the compressor inlet and/or outlet side, and determining individual flow rates of gas, water and non-aqueous liquid on the basis of the measured individual volume fractions of gas, water and non aqueous liquid and the fluid velocity at the compressor inlet and/or outlet side.

9 Claims, 4 Drawing Sheets

(56) References Cited

U.S. PATENT DOCUMENTS

| | | | | |
|---|---|---|---|---|
| 4,399,548 | A | 8/1983 | Castleberry | |
| 4,825,380 | A | 4/1989 | Hobbs | |
| 4,971,516 | A | 11/1990 | Lawless et al. | |
| 5,798,941 | A | 8/1998 | McLeister | |
| 5,967,742 | A * | 10/1999 | Mirsky | F04D 27/00 415/1 |
| 6,213,724 | B1 | 4/2001 | Haugen et al. | |
| 6,503,048 | B1 | 1/2003 | Mirsky | |
| 7,094,019 | B1 | 8/2006 | Shapiro | |
| 2002/0077727 | A1 * | 6/2002 | Rentmeester | F25B 41/062 700/282 |
| 2003/0010502 | A1 * | 1/2003 | Poorte | F04D 31/00 166/373 |
| 2011/0048546 | A1 * | 3/2011 | Bjorge | E21B 43/01 137/154 |
| 2011/0280738 | A1 * | 11/2011 | Narayanan | F04D 27/0207 417/53 |

FOREIGN PATENT DOCUMENTS

| | | | |
|---|---|---|---|
| EP | 0366219 | A2 | 5/1990 |
| EP | 0676545 | A2 | 10/1995 |
| WO | 0238963 | A1 | 5/2002 |
| WO | 2010040734 | A1 | 4/2010 |

* cited by examiner

METHOD AND APPARATUS FOR COMPOSITION BASED COMPRESSOR CONTROL AND PERFORMANCE MONITORING

The present invention relates to a method and apparatus for detecting impending surge conditions in a gas compressor and for anti-surge control and mapping of a gas compressor based on real time measurement of gas compositions and/or individual gas and/or liquid flow rates of the working fluid. Mapping is recognized as identifying the compressor working points inside the compressor operating envelope, and parameters, such as actual volumetric flow rate and/or pressure ratio, are often used for this purpose.

Surge, or stall, is the lower limit of stable operation of a compressor where a further reduction in the volumetric flow rate will create a surge incident. Onset of surge is associated with flow instabilities, flow reversal in the compressor and a complete breakdown of the compressor performance. Surge can be caused by changes in flow rate, changes in fluid compositions, changes in operation conditions, or due to flow disturbances. It is important to be able to avoid surge to take place by corrective actions since surge can cause severe damage to the compressor internals. A boundary limit denoted surge line is created based on the pressure ratio and volumetric flow rate where onset of stall is identified inside the machine. Such a surge line is covering all combinations of pressure ratios and volumetric flow rates that are possible to obtain within the speed range of the machine. The surge line represents the lower volumetric flow rate limit where it is possible to operate the compressor.

The surge limit is an experimentally determined curve which relates pressure ratio versus actual volumetric flow rate at the point where stall is detected for different compressor rotational speeds. A further reduction in volumetric flow rate at this point with a constant rotational speed will initiate surge:

$$\text{Surge curve} = f\left[\frac{p_2}{p_1}, Q_G\right] \tag{1}$$

where $Q_G$ is the gas volumetric flow through the compressor, and $p_1$ and $p_2$ are the pressures measured respectively before and after the compressor. The flow rate given in (1) could alternatively be represented by the differential pressure against the flow device normally installed upstream of the machine.

The main objective for an anti-surge system is to maintain high system robustness and cost effective operation of the compressor system. Such implementation of an accurate control routine increases the machine operating envelope, and less recycle flow is required when operating at the control line. Favorable control routines ensure that the compressor can be utilized close to the surge and choke limit with only a small safety margin. An increase of the operating envelope is favorable for long term operation with high variation of flow and pressure ratios since this variation often tends to require a redesign of the machine if the envelope is limited.

Common approaches for preventing a compressor to enter the surge regime include speed control and increase of volumetric flow rate at the compressor inlet by recirculation of gas from the discharge by opening an anti-surge valve. Fast anti-surge routines are normally based on recirculation of compressed gas that is re-fed into the compressor, the recirculation being controlled in real time by a recirculation valve (U.S. Pat. No. 3,424,370, Centrifugal Compressors—a basic guide, Penwell Corporation 2003).

All surge control systems depend on the measurement of one or several signals that contain(s) information that can be used to give a warning about onset of surge. Various means have been employed to monitor various operational parameters of a compressor, and to use these measurements to control the operation of the compressor to avoid surge. The signals that are being used to control surge can be based on measurements of temperatures and pressures upstream and/or downstream the compressor unit, vibration monitoring, or by measuring the actual gas flow rate on the compressor inlet or outlet.

There are numerous systems in the prior art for control of the flow of gases in a recycle line connected between the discharge and inlet of a centrifugal compressor for the purpose of positively preventing the compressor from going into surge. U.S. Pat. No. 3,292,846 dated Dec. 20, 1966, shows a control system of this type in which flow in the recycle line is made responsive to density of the discharge gas and the speed of the compressor to maintain a sufficient flow through the compressor to prevent surging thereof.

Some methods are based on measurements of pressure and temperatures at inlet and outlet section of the compressor where the measured profile is compared to a known behavior of the compressor. An anti-surge system based on the measurement of temperature is e.g. described in CA 2522760, whereas a system based on the measurement the rate of change of characteristic variables like temperature, differential pressure, power consumption is described in U.S. Pat. No. 6,213,724. These types of measurements are however too slow in many real situations where flow properties may change rapidly.

Many prior art systems measure and compute the compressor's operating point relative to a surge line that is determined based on conventional performance curves for various conditions, and measured volumetric flow rate of the gas is used as a the basis for the control routines. One example of such a system is described in U.S. Pat. No. 4,156,578 where surge is avoided by the measurement across the inlet and discharge side of a compressor of such variables as compressor inlet pressure, compressor outlet pressure, and the differential pressure across a flow device disposed in an inlet duct of the compressor. The surge conditions are also dependent on the gas properties, especially the molecular weight of the gas. U.S. Pat. No. 4,825,380 describes a method where the real time molecular weight of the gas is estimated on-line from actual measurements of flow, pressure, temperature and speed along with compressor performance data.

Even though the most common method for measuring flow rate through a gas compressor is by use of differential pressure devices, also other flow metering devices can be used. U.S. Pat. No. 4,971,516 describes a method and apparatus for operating compressors based on the measurement of the volumetric flow rate of gas through the compressor via the use of an acoustic flow meter. Acoustic based flow metering systems will however not work properly if the gas contains liquids because the liquid droplets or liquid film will cause scattering of sound waves that disturbs the measurements significantly.

In addition to the mentioned methods that are based on measurement of characteristics of the working fluid flowing through the compressor another method is to base the control on the monitoring of the status of the compressor machinery. U.S. Pat. No. 4,399,548 describes anti-surge routines that are based on measurement of the machinery vibration level. This approach suffers the limitation that different compressors have different signature patterns of pressure fluctuations and the method is hence associated with large uncertainties.

Common for all the methods above is that they suffer from reduced accuracy and reliability if the gas contains liquids or the gas composition is changing during operation of the compressor. For certain applications, for example for compression of a wet gas that contains a certain amount of liquid, the prior art control systems will usually have significant measurement errors that can result in inefficient compressor operation and/or failure to prevent surge. This is because these prior art systems do not take into account the presence of liquid in the gas. Conventional flow rate measurement systems are not able to discriminate between gas and liquids and are consequently associated with a significant volumetric flow rate uncertainties. E.g. for a measurement system that is based on the measurement of differential pressure as the fluid is accelerated through a flow constriction, presence of liquids with a high density will increase the differential pressure as if the volumetric flow rate of gas was higher than actual and create large uncertainties between the measured and actual volumetric flow rate. In wet gas compressor applications, where the working fluid consists of a gas containing certain amounts of liquid, such increased uncertainties are particularly pronounced due to the combination of high liquid rate and large density difference between the gas and the liquid phase. In traditional systems, this can be interpreted as a large variation of the volumetric gas flow rate which does not necessarily represent the physical reality.

The result, when using conventional compressor control systems, for cases where the gas composition is changing or the gas is containing certain amounts of liquids, might be that the compressor is entering the surge regime for no apparent reason because the surge line being used to control the compressor becomes incorrect. It might also be that too large safety margins will have to be introduced, causing an operation regime that is not optimal.

Condition monitoring of compressors in operation is important in order to observe degradation due to changed process boundaries, fouling and internal damages. Calculation of the polytropic head that represents the calculated work done by the compressor is normally performed according to equation (2):

$$Y_P = \frac{n_P}{n_P - 1} \cdot \frac{R_0}{MW_G} \cdot Z_1 \cdot T_1 \cdot \left[\left(\frac{p_2}{p_1}\right)^{\frac{n_P-1}{n_P}} - 1\right] = \frac{n_P}{n_P - 1} \cdot \frac{p_1}{\rho_{G1}} \cdot \left[\left(\frac{p_2}{p_1}\right)^{\frac{n_P-1}{n_P}} - 1\right] \tag{2}$$

where $R_0$ is the universal gas constant, $MW_G$ is the molecular weight of the gas, $Z_1$ is the gas compressibility factor, $T_1$ is the suction side temperature, $\rho_{G1}$ is the inlet gas density, $p_1$ is the inlet pressure, $p_2$ is the outlet pressure, and $n_P$ is the polytropic exponent.

Alternatively the polytropic head can also be calculated according to equation (3):

$$Y_P = \frac{n_P}{n_P - 1} \cdot \left[\frac{p_2}{\rho_{G2}} - \frac{p_1}{\rho_{G1}}\right] \tag{3}$$

where,

-continued $$n_P = \frac{\ln\left(\frac{p_2}{p_1}\right)}{\ln\left(\frac{\rho_{G2}}{\rho_{G1}}\right)} \tag{4}$$

The gas density on the compressor outlet is represented by $\rho_{G2}$ in equation (3) and (4).

Further the compressor polytropic efficiency is determined by $$\eta_P = \frac{Y_P}{h_{G2} - h_{G1}} \tag{5}$$

where $h_{G1}$ and $h_{G2}$ represent the gas enthalpy on the compressor inlet and outlet, respectively. This change in enthalpy reflects the actual fluid energy given to the fluid through the compressor.

In conventional compressor application no measurement of the gas density is performed so this property is calculated with use of a selected equation of state (EOS) and is sensitive to change in the actual gas composition that normally changes in time.

Present state of the art compressor performance calculation is not applicable when liquid is present in the gas, since equations (2), (3), (4) and (5) are restricted to gas only and may be incorrect even for gas as the gas composition changes over time.

It is one aim of this invention to overcome the above mentioned limitations of existing solutions and to integrate a composition and flow measurement solution into the compressor control system in order to achieve a more accurate, more robust and more efficient operation of gas compressors.

It is another aim of the invention to provide accurate measurement of the liquid fraction of a wet gas flowing through a gas compressor.

It is yet another aim of the invention to provide accurate measurement of the gas and total density of the working fluid flowing through a gas compressor.

It is a further aim of the invention to provide accurate measurement of the molecular weight of the working fluid flowing through a gas compressor.

It is yet a further aim of the invention to provide accurate measurement of the total volumetric flow rate of the working fluid flowing through a gas compressor.

It is another aim of the invention to provide accurate real time measurement of the total volumetric flow rate of the working fluid flowing through a gas compressor when the gas composition is changing over time.

It is an additional aim of the invention to provide real time values for fluid properties like molecular weight, density and compressibility of the working fluid flowing through a gas compressor when the gas composition is changing over time.

It is a further additional aim of the invention to use measured total volumetric flow rate, measured machine pressure ratio or calculated head, and measured working fluid properties to accurately determine the operation point of a gas compressor when the composition of the working fluid contains uncertainties.

It is yet another aim of the invention to use measured total volumetric flow rate, measured machine pressure ratio or calculated head, and measured working fluid properties to accurately determine the operation point of a gas compressor when the gas contains uncertain amounts of liquids.

It is a further aim of the invention to use measured real-time total volumetric flow rate, measured machine pressure ratio or calculated head, and measured working fluid properties to accurately determine the operation point of a gas compressor when the working fluid composition is changing over time.

It is another aim of the invention to measure the liquid fraction flowing through the compressor and thereby be able to have a floating control line used for surge protection that will depend on the liquid fraction entering the machine.

It is an additional aim of the invention to use the measured machine pressure ratio or calculated head and flow rate dependent real time operation point to determine the set point of a gas compressor when the gas composition contains uncertainties or uncertain amounts of liquids.

It is yet another additional aim of the invention to improve the accuracy and robustness of surge prevention routines by use of the accurately measured total volumetric flow rate to start recirculation of the working fluid if the operation point is too close to the compressor surge regime.

It is another aim of the invention to utilize the flow meter computer to perform the active anti-surge control and directly control valves used to re-circulate gas from the discharge to the inlet to the compressor.

It is another aim of the invention to use measured total volumetric flow rate, measured gas properties and measured pressure ratios at different flow rates and pressure ratios to accurately determine the surge limit for a gas compressor.

It is yet another aim of the invention to use the determined surge limit and a given safety margin at different flow rates and different fluid compositions to accurately determine a multidimensional surge control surface.

It is a further aim of the invention to use measured total volumetric flow rate, measured gas composition, measured gas properties and measured pressure ratios at different flow rates and pressure ratios to accurately determine the choke limit for a gas compressor.

It is yet a further aim of the invention to use measured total volumetric flow rate, and measured gas properties at different flow rates and different fluid compositions to accurately determine an equivalent volume flow rate for a gas compressor.

It is another aim of the invention to define new compressor performance equations being able to calculate parameters such as polytropic head, polytropic exponent and efficiency when liquid is present in the gas flow.

It is yet another aim of the invention to detect compressor performance changes due to liquids present in the feeding flow.

It is a further aim of the invention to determine how the total volumetric flow rate of liquid and gas is changing through the compressor flow path.

These and other aims are achieved by means of a method according to independent claim 1 and an apparatus according to the independent claim 5. Further advantageous and/or alternative embodiments and features are set out in the dependent claims.

In the following is a detailed description of the present invention under reference to the drawings, where:

Figure 1:
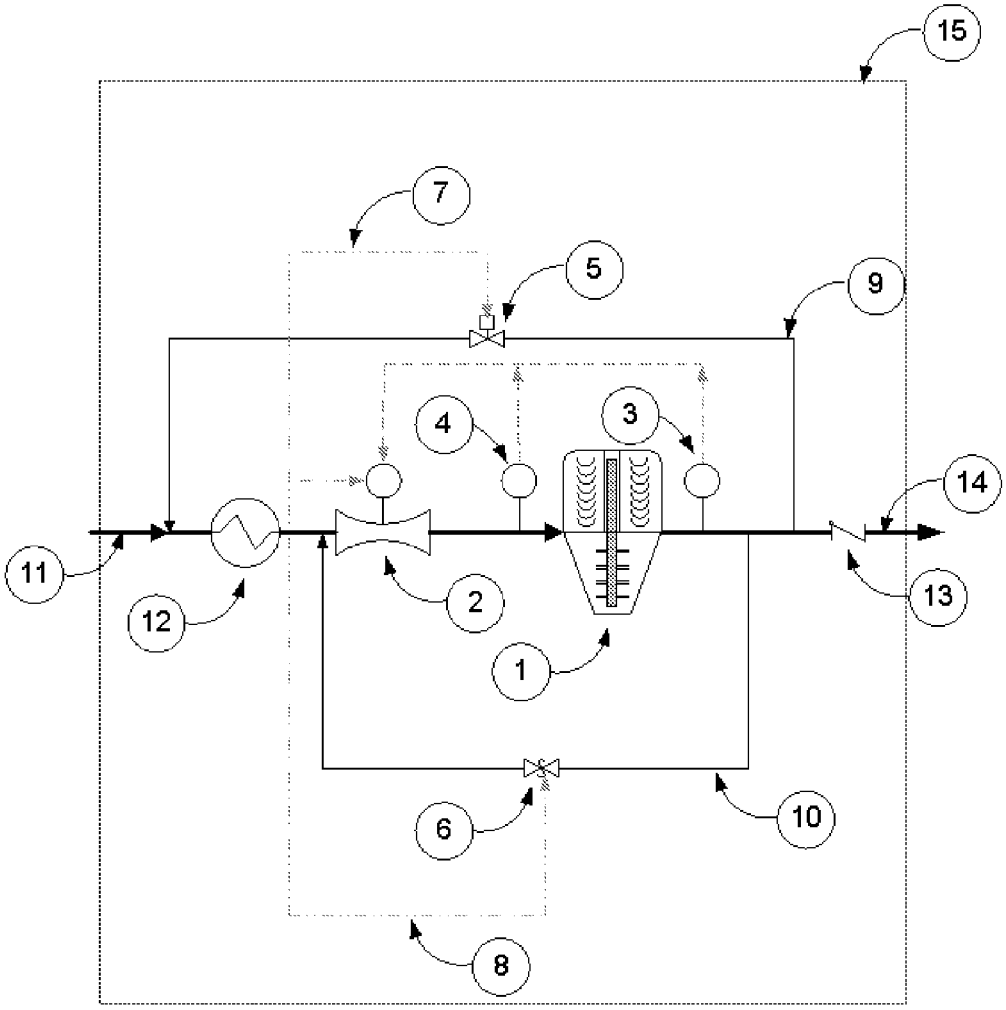
FIG. 1 shows a schematic illustration of the compressor system that includes the main elements of the invention.

The present invention relates to a method and an apparatus for controlling the operation and performance of a gas compressor 1 when the gas properties are unknown or changing in time, or when the gas contains liquid. The invention is used to ensure optimum operation of a compressor system 15 of the kind shown in FIG. 1. A fluid containing gas and liquid is brought to the system 15 through a pipeline 11 and optionally enters a cooler 12. A flow meter 2 measures the actual volumetric flow rate of the gas and liquid upstream of the compressor 1. The fluid pressure and temperature are measured by a fluid pressure and temperature measuring device 4 upstream and a fluid pressure and temperature measuring device 3 downstream the compressor 1, whereas pressure and temperature readings from the fluid pressure and temperature measuring devices 4, 3 are sent to the flow meter 2. Two different and optional recycle lines are shown: an anti-surge line 9 containing an anti-surge valve 5, and a hot gas bypass line containing a hot gas bypass valve 6. Both valves 5 and 6 are connected to the flow meter 2, enabling control of the valves directly from the flow meter 2. The fluid entering into the compressor system 15 is pressurized by the compressor 1 and leaves the compressor system 15 through a check valve 13 and a pipeline 14. The flow meter 2 controls the compressor 1 operating point by measuring the actual volumetric flow rate entering the compressor 1 and by calculating the pressure ratio derived from measuring devices 3 and 4. By way of example, if recycle of fluid is required to ensure stable operation or/and protection of the compressor 1, the flow meter 2 may open the anti-surge valve 5 in the anti-surge line 9 or, alternatively, open the hot gas bypass valve 6 in the hot gas bypass line 10. The flow metering device 2 can alternatively be installed in the vicinity of the compressor outlet or one or more similar flow meter devices may be installed both in the vicinity of the compressor inlet and outlet. Measured properties from the flow metering device(s) are then used to calculate the compressor performance parameters such as polytropic head (ref. equation 6 below) and polytropic efficiency (ref. equation 12 below). Control lines 7, 8 communicate with determination/computer and/or controlling means (FIG. 2).

An object of the present invention is to accurately determine the actual flow rate through the compressor 1 even in cases where the gas molecular weight changes over time or if the gas contains unknown amounts of liquid, either water or non-aqueous liquid. Such measurements are important in order to determine accurately the working fluid density, the working fluid molecular weight, and the total volumetric flow rate that includes both the gas and liquid phase.

The flow metering device 2 contains devices for determining the individual fraction of gas, water, and non-aqueous liquids, devices for measurement of temperature and pressure for compensation purposes, as well as devices for measurement of fluid velocity.

The invention also relates to a method for using the measured fractions and flow velocities to determine the individual flow rates of gas, water, and non-aqueous liquids, total fluid density and molecular weight.

Referring to FIG. 2, the flow measurement device 22 may comprise six main elements as shown: a tubular section 16, a device 17 for measuring the velocity of the working fluid, a device 18 for measuring the water fraction of the working fluid, a device 19 for measuring the density of the working fluid, a device 20 for measuring the pressure and temperature of the working fluid. A computer device (computing means) 21 and/or controlling means receives data from measuring devices 17, 18, 19, 20 in addition to pressure and temperature data measured by devices 3 and 4 inside the compressor system 15 shown in FIG. 1. The computing means and the controlling means can be one device or two separate devices. In case of two separate units or devices, they should be linked and able to communicate with each other. The surge protection algorithm based on the measured total volumetric flow rate and the compressor pressure ratio is implemented into the computer and/or controlling means 21 that is an integral part of the flow meter. Based on data received, the computer and/or controlling means 21 is determining the fluid composition and is sending data to other control systems that are connected thereto. The flow direction may be either upward or downward. The device may also be located either horizontally or having any other inclination. The device can be located at the compressor suction or discharge side or both sides of the machine.

Figure 3:
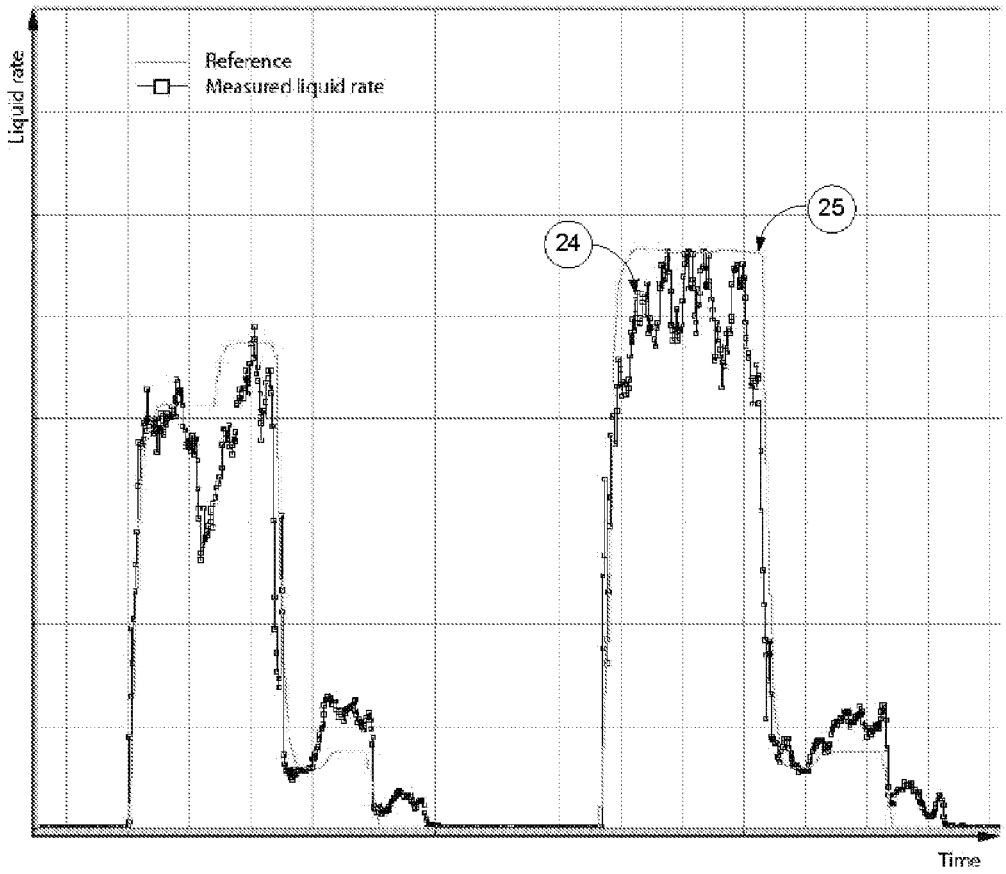
FIG. 3 shows the measured liquid fraction of a wet gas versus a reference value as a function of time.

For application of composition dependent compressor control, it is crucial that the accuracy of liquid fraction measurement is high, and that the flow meter 2 is able to detect sudden fluid changes to ensure safe machine operation and control. FIG. 3 shows examples of performance obtained in a flow laboratory for an actual flow metering device.

FIG. 3 is self-explaining and shows the measured liquid fraction (rates) 24 (y-axis) of a wet gas versus a reference value (a reference liquid rate line) 25 as a function of time (x-axis).

Figure 2:
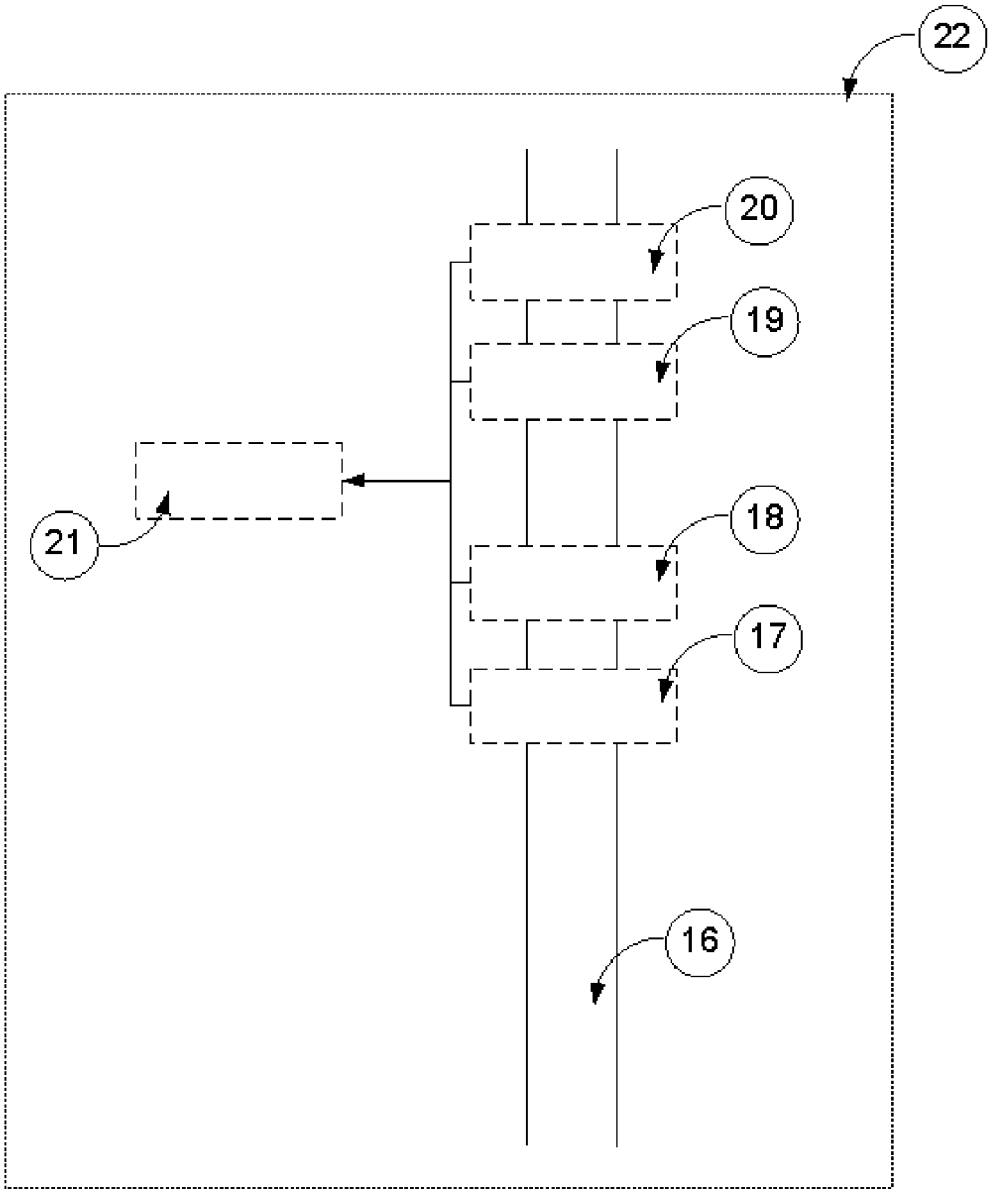
FIG. 2 shows a schematic longitudinal sectional view of the main elements of the flow measurement device.

The present invention includes a new set of equations used to calculate the compressor performance where the main parameters are measured by a flow metering device 2 as shown in FIG. 1. Such equations are also valid when liquid is present in the gas flowing through the machine and are suggested used for performance monitoring of the machine.

A polytropic head equation that is valid for dry gas and when liquid and gas are mixed on the compressor inlet is introduced as:

$$Y_{TP} = \frac{n_{TP-2}}{n_{TP-2} - 1} \cdot \left[\frac{p_2}{\rho_{H2}} - \frac{p_1}{\rho_{H1}}\right] \tag{6}$$

where $$n_{TP} = \frac{\ln\left(\frac{p_2}{p_1}\right)}{\ln\left(\frac{\rho_{H2}}{\rho_{H1}}\right)} \tag{7}$$

Equation (6) is denoted single-fluid model as the densities of various fluids are combined into a bulk density of the mixture representing one fluid. Subscript TP used reflects that the equation is valid also for two-phase flow (mixture of gas and liquid).

The bulk density of the gas and liquid mixture are represented by $$\rho_{H1}=\alpha_{G1}\cdot\rho_{G1}+\alpha_{C1}\cdot\rho_{C1}+\alpha_{nonA1}\cdot\rho_{nonA1}+\alpha_{W1}\cdot\rho_{W1} \tag{8}$$

and $$\rho_{H2}=\alpha_{G2}\cdot\rho_{G2}+\alpha_{C2}\cdot\rho_{C2}+\alpha_{nonA2}\cdot\rho_{nonA2}+\alpha_{W2}\cdot\rho_{W2} \tag{9}$$

where the void fraction of each phase is recognized as $$\alpha_{Fn} = \frac{A_{Fn}}{A_{CR}} \tag{10}$$

Each phase has in equations (8) and (9) a hold-up area represented by $A_{Fn}$ occupied in the pipe cross-sectional area $A_{CR}$. Subscript F in equation (10) represents the different fluids present, and in this case gas (G), condensate (C), non-aqueous (nonA), and water (W). Similar subscript n represents the inlet 1 and outlet 2. If no slip exists among the different phases (same velocity), equation (10) could be based on the volumetric flow rates of the different phases:

$$\alpha_{Fn} = \frac{Q_{Fn}}{Q_{Tot}} \tag{11}$$

The total volumetric flow rate is represented by $Q_{Tot}$ in equation (11). Compressor efficiency is then calculated according to:

$$\eta_{TP} = \frac{Y_{TP}}{h_{TP2} - h_{TP1}} \tag{12}$$

where $h_{TP2}$ (n=2) and $h_{TP1}$ (n=1) are defined as:

$$h_{TPn}=\beta_{Gn}\cdot h_{Gn}+\beta_{Cn}\cdot h_{Cn}+\beta_{nonAn}\cdot h_{nonAn}+\beta_{Wn}\cdot h_{Wn} \tag{13}$$

Calculation of the enthalpy based on equation (13) utilizes the mass fraction of each phase present in the flow at the inlet (n=1) and outlet (n=2) of the machine:

$$\beta_{Fn} = \frac{m_{Fn}}{m_{Tot}} \tag{14}$$

Mass flow rate is denoted m and subscript Tot reflects the total flow in equation (14). Subscript F in equation (10) represent the different fluids present, and in this case gas (G), condensate (C), non-aqueous (nonA), and water (W).

For dry gas only, equations (6) and (7) are identical to equations (3) and (4) respectively since all liquid fractions are zero and will not contribute in the equations. The use of the flow metering device 2 in FIG. 1 ensures that the gas density is measured and the molecular weight of the gas is known and hence the calculated work done by the machine is accurately determined. If a flow metering device 2 is utilized both on the compressor inlet and outlet side, all relevant parameters needed to calculate the compressor head (equations (6) and (7)) may be measured and the uncertainties in the known equations of states (EOS) and possible changed gas composition is eliminated.

Similarly, if the process gas contains water (W), condensate (C) or/and other non-aqueous (nonA) liquids the calculated head is still valid with use of equations (6) and (7) since all liquid fractions are measured by the flow metering device 2 in FIG. 1. The bulk density of the mixture is measured by the flow metering device 2, measuring all parameters used in equations (6) and (7), which reduces the uncertainties in the calculation.

An object of the present invention is to avoid surge by control of the recirculation valve or an on/off valve known as hot-gas bypass valve based on a real-time measurement of the compressor performance and the actual volumetric flow rate of gas and liquids through the machine.

The surge phenomenon in a gas compressor depends on total volumetric flow rate, pressure ratio, machine condition, and on the composition and molecular weight of the gas.

The polytropic head $Y_P$ is a function of gas composition through the molecular weight, compressibility and the compression coefficient and is also a function of the pressure ratio and the inlet temperature:

$$Y_P = f\left[n_P, \rho_G, p_1, \frac{p_2}{p_1}\right] \quad (15)$$

The surge limit is an experimentally determined curve which relates pressure ratio versus actual volumetric flow rate at the point where stall is detected for different compressor rotational speeds. A further reduction in volumetric flow rate at this point with a constant rotational speed will initiate surge:

$$\text{Surge curve} = f\left[\frac{p_2}{p_1}, Q_{Tot}\right] \quad (15)$$

alternatively $$\text{Surge curve} = f[Y_P, Q_{Tot}] \quad (15)$$

where $Q_{Tot}$ is the total volumetric flow through the compressor:

$$Q_{Tot} = Q_G + Q_L \quad (16)$$

and the liquid flow rate ($Q_L$) can be divided into non-aqueous liquid and water:

$$Q_L = Q_W + Q_C + Q_{nonA} \quad (17)$$

The surge line, which normally is defined by the use of the differential pressure from a flow meter device and the pressure ratio across the machine, is not applicable if liquids are present in the gas flow. By using the flow metering device 2 in FIG. 1 the actual volumetric flow rate could be used as a surge control parameter together with the pressure ratio since the total volumetric flow rate is measured and thereby valid for both a dry gas and a mixture consisting of gas and liquid. In the case that the flow metering device 2 is utilized on both the inlet and outlet side of the machine, the polytropic head could be used instead of the pressure ratio in the surge control since the density of gas and liquids is measured directly and is not dependent on a temperature measurement that has a slow response when gradients occur.

The actual operation point for the gas compressor is defined by the actual polytropic head or the pressure ratio and the actual total flow rate at a certain point in time.

Figure 4:
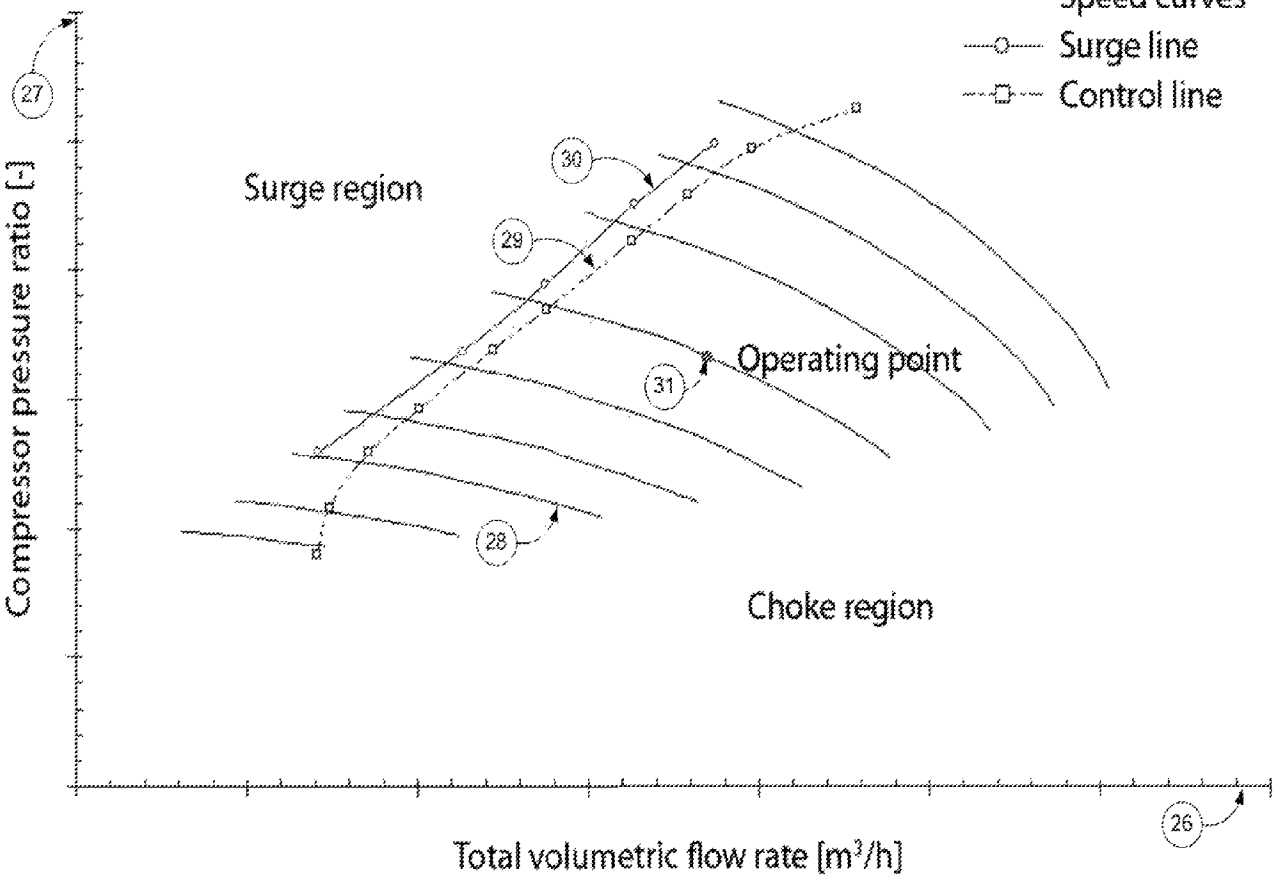
FIG. 4 shows an illustration of a typical compressor map with operation point, surge curve, surge region, choke region, and control line (safety margin).

Referring now to FIG. 4, an operation point 31 in a compressor map with a surge line 30, and a control line 29 is illustrated. Furthermore, the x-axis 26 shows the total volumetric flow rate, the y-axis 27 shows the pressure ratio across the machine, and the bands of curved lines 28 show the constant speed lines. If the pressure ratio at the actual operation point 31 exceeds the surge control line 29 towards left, the recirculation valve is opened. The surge control line 29 is given as the surge line 30 plus a safety margin. Actuating of the recirculation valve could be done directly by the flow meter computer or by an external control system that receives data from the flow meter 2.

In the case that the flow metering device is utilized on both the inlet and outlet side of the machine, the liquid fraction can be measured on the inlet and outlet side of the compressor 1. Fouling of the compressor internals may take place as liquid is evaporates in the machine, and such fouling may significantly effect the compressor operating envelope. Hence the surge line may change as evaporation of liquid takes place. According to one embodiment of the present invention, a routine could be incorporated into the anti-surge control logic and give warning if the liquid fraction results in short term degradation by measuring the liquid rates entering and leaving the machine. Alternatively, a floating control line logic could be implemented to control the machine while the liquid is evaporated through the compressor.

In the case that the flow metering device is utilized on both the inlet and outlet side of the machine, the fluid density change due to evaporation of liquid through the compressor could be utilized to determine the fluid composition.

If large quantities of liquid (slug) arrives or appears in the machine during operation, two flow metering devices could be utilized upstream the machine. The distance between these two flow meters must be selected to ensure that enough time is available to open the recycle valve 5, ref. FIG. 1, or reduce the compressor operating speed before the liquid slug enters the machine. Such flow metering devices could be connected to each other to ensure a fast response.

The invention claimed is:

1. A method for surge protection of a compressor with an inlet and outlet side, wherein an inlet gas flow or stream of the compressor comprises time-varying amounts of water and/or non-aqueous liquid, by continuously or discontinuously measuring and/or determining various parameters of the fluids passing through said compressor, the method comprising the steps of:

a) measuring temperature at the compressor inlet and/or outlet side, b) measuring pressure at the compressor inlet and outlet sides in order to determine a compressor pressure ratio, c) measuring fluid mixture density at the compressor inlet and/or outlet side, d) measuring individual volume fractions of gas, water and non-aqueous liquid at the compressor inlet and/or outlet side, e) measuring fluid velocity at the compressor inlet and/or outlet side, f) determining individual flow rates of gas, water and non-aqueous liquid on the basis of the measured individual volume fractions of gas, water and non-aqueous liquid and the fluid velocity at the compressor inlet and/or outlet side, g) based on the determined individual flow rates of gas, water and non-aqueous liquid, determining an actual fluid mixture total volumetric flow rate of gas and liquid at the compressor inlet and/or outlet side, and h) on the basis of the determined compressor pressure ratio and the determined actual fluid mixture total volumetric flow according to steps a-g, controlling a recirculation valve position of at least one recirculation valve arranged between the inlet and outlet side of said compressor in order to ensure that the compressor does not enter into a surge regime;

wherein a compressor performance is determined on the basis of the measured fluid mixture total density and determined parameters such as gas composition, gas and liquid properties and by means of a polytropic head equation:

$$Y_{TP} = \frac{n_{TP}}{n_{TP} - 1} \cdot \left[\frac{p_2}{\rho_{H2}} - \frac{p_1}{\rho_{H1}}\right]$$

where $Y_{TP}$ reflects that the equation is valid also for two-phase flow, and where $\rho_{H1}$ is the inlet bulk density of the gas and liquid mixture, $\rho_{H2}$ is the outlet bulk density of the gas and liquid mixture, $p_1$ is the inlet pressure, $p_2$ is the outlet pressure, and $n_{TP}$ is determined by:

$$n_{TP} = \frac{\ln\left(\frac{p_2}{p_1}\right)}{\ln\left(\frac{\rho_{H2}}{\rho_{H1}}\right)}$$

and where a compressor efficiency is then calculated according to:

$$\eta_{TP} = \frac{Y_{TP}}{h_{TP2} - h_{TP1}}$$

where $h_{TP2}$ (n=2) and $h_{TP1}$ (n=1) are defined as:

$$h_{TPn}=\beta_{Gn}\cdot h_{Gn}+\beta_{Cn}\cdot h_{Cn}+\beta_{nonAn}\cdot h_{nonAn}+\beta_{Wn}\cdot h_{Wn}$$

where β is the mass fraction of each of the gas (G), condensate (C), non-aqueous liquid (nonA) and water (W) phases present in the flow at the inlet (n=1) and outlet (n=2).

2. A method according to claim 1, wherein the recirculation valve position is controlled on the basis of the compressor performance, derived from the determined pressure ratio, and the determined actual fluid mixture total volumetric flow according to steps a-g.

3. A method according to claim 1, wherein gas is recirculated from the outlet side to the inlet side of the compressor when the liquid fraction exceeds a maximum determined value and/or pulsates.

4. An apparatus for surge protection of a compressor, where the compressor inlet gas flow or stream contains time-varying amounts of water and/or non-aqueous liquid, by continuously or discontinuously measuring and/or determining various parameters of the fluids passing through said compressor, the apparatus comprising:

a) a measuring device configured to measure temperature at the compressor inlet and/or outlet side, b) a measuring device configured to measure pressure at the compressor inlet and outlet side in order to determine the compressor pressure ratio, c) a measuring device configured to measure fluid mixture density at the compressor inlet and/or outlet side, d) a measuring device configured to measure individual volume fractions of gas, water and non-aqueous liquid at the compressor inlet and/or outlet side, e) a measuring device configured to measure fluid velocity at the compressor inlet and/or outlet side, f) a computing device configured to determine individual flow rates of gas, water and non-aqueous liquid on the basis of the measured individual volume fractions of gas, water and non-aqueous liquid and fluid velocity at the compressor inlet and/or outlet side, and for determining an actual fluid mixture total volumetric flow rate of gas and liquid at the compressor inlet and/or outlet side on the basis of the determined individual flow rates of gas, water and non-aqueous liquid, and g) a controller configured to control a recirculation valve position of at least one recirculation valve arranged between the inlet and outlet side of said compressor in order to ensure that the compressor does not enter into a surge regime on the basis of data, including the determined actual fluid mixture total volumetric flow, from the computing device;

wherein a compressor performance is determined on the basis of the measured fluid mixture total density and determined parameters such as gas composition, and gas and liquid properties and by means of a polytropic head equation:

$$Y_{TP} = \frac{n_{TP}}{n_{TP} - 1} \cdot \left[\frac{p_2}{\rho_{H2}} - \frac{p_1}{\rho_{H1}}\right]$$

where $Y_{TP}$ reflects that the equation is valid also for two-phase flow, and where $\rho_{H1}$ is the inlet bulk density of the gas and liquid mixture, $\rho_{H2}$ is the outlet bulk density of the gas and liquid mixture, $p_1$ is the inlet pressure, $p_2$ is the outlet pressure, and $n_{TP}$ is determined by:

$$n_{TP} = \frac{\ln\left(\frac{p_2}{p_1}\right)}{\ln\left(\frac{\rho_{H2}}{\rho_{H1}}\right)}$$

and where a compressor efficiency is then calculated according to:

$$\eta_{TP} = \frac{Y_{TP}}{h_{TP2} - h_{TP1}}$$

where $h_{TP2}$ (n=2) and $h_{TP1}$ (n=1) are defined as:

$$h_{TPn}=\beta_{Gn}\cdot h_{Gn}+\beta_{Cn}\cdot h_{Cn}+\beta_{nonAn}\cdot h_{nonAn}+\beta_{Wn}\cdot h_{Wn}$$

where β is the mass fraction of each of the gas (G), condensate (C), non-aqueous liquid (nonA) and water (W) phases present in the flow at the inlet (n=1) and outlet (n=2).

5. An apparatus according to claim 4, wherein the compressor comprises two or more recirculation valves.

6. An apparatus according to claim 4, wherein the computing device and/or the controller is located remotely from the measuring devices.

7. An apparatus according to claim 4, wherein the computing device and the controller are integrated in one unit or device.

8. An apparatus according to claim 4, wherein the computing device and the controller are two separate units or devices communicating with each other.

9. An apparatus according to claim 4, wherein the controller is configured to control the recirculation valve position on the basis of the compressor performance, derived from the determined pressure ratio, and the determined actual fluid mixture total volumetric flow.

* * * * *